US006355349B2

(12) United States Patent
Chizmas

(10) Patent No.: US 6,355,349 B2
(45) Date of Patent: Mar. 12, 2002

(54) REFLECTIVELY ENHANCED COATED CABLE

(76) Inventor: Jeffrey J. Chizmas, 2401 Lewis O. Gray, Saugus, MA (US) 01906

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,225

(22) Filed: Apr. 23, 1999

Related U.S. Application Data

(60) Provisional application No. 60/082,770, filed on Apr. 23, 1998.

(51) Int. Cl.[7] ..... B32B 27/00; H01B 7/00

(52) U.S. Cl. ..... 428/383; 428/322; 428/323; 428/379; 174/112; 174/120 SR

(58) Field of Search ..... 174/112, 120 SR; 428/379, 383, 372, 323

(56) References Cited

U.S. PATENT DOCUMENTS 2,009,004 A * 7/1935 Schatzel ..... 174/112
2,945,265 A * 7/1960 Sell, Jr. et al. ..... 174/112
3,663,359 A * 5/1972 Braim ..... 174/112
4,161,564 A * 7/1979 Legbandt ..... 174/112
4,423,306 A * 12/1983 Fox ..... 174/112
4,579,759 A * 4/1986 Breuers ..... 174/112
5,142,105 A * 8/1992 Kihlken et al. ..... 174/112
5,281,764 A * 1/1994 King et al. ..... 174/112
5,286,922 A * 2/1994 Curtiss ..... 174/112
5,357,058 A * 10/1994 Tanihira et al. ..... 174/112

* cited by examiner

*Primary Examiner*—Cynthia H. Kelly
*Assistant Examiner*—J. M. Gray
(74) *Attorney, Agent, or Firm*—Wechsler & Wechsler, P.C.; Lawrence I. Wechsler

(57) ABSTRACT

A coated cable includes a structural core made of twined wire or other suitable material, and an outer layer surrounding the structural core, such outer core being transparent to light. The cable further provides a material which is reflective to incident light, effective to reflect light from the cable in a manner discernable to an observer. In an advantageous embodiment, this is accomplished by a reflective layer interposed between the structural core and the outer layer, the reflective layer being provided in the form of a wrapped tape disposed below the outer layer.

16 Claims, 1 Drawing Sheet

REFLECTIVELY ENHANCED COATED CABLE

CROSS REFERENCE TO RELATED APPLICATIONS

This application claims the benefit of U.S. Provisional Application No. 60/082,770 filed Apr. 23, 1998 entitled REFLECTIVELY ENHANCED COATED CABLE.

BACKGROUND OF THE INVENTION

The present invention relates generally to coated cables, and more particularly, to thermoplastic coated cables for use in applications in which enhanced visibility of same is advantageous, such as in support cables, animal tie-outs and restraints, fences, barriers and walkways.

The prior art does not adequately address the need for a coated cable which, by virtue of enhanced reflective properties, could provide improved viewability in daylight or when impinged by any type of light including sunlight or artificial light beam in subdued light or darkened surroundings.

OBJECTS AND SUMMARY OF THE INVENTION

It is an object of the invention to provide a coated cable which overcomes the drawbacks of the prior art.

It is a further object of the invention to provide a coated cable which provides enhanced viewability when light is reflected therefrom by an external light source.

It is a still further object of the invention to provide a coated cable with reflectively enhanced properties such that it is visually highlighted when struck by light.

Still a further object of the invention is to provide a coated cable with reflectively enhanced properties in a form which is resistant to exposure to the elements such that the quality of such reflection is not significantly diminished over time.

It is a yet a further object of the invention to provide a cable with such properties in a manner which is cost effective such that a product fashioned from such cable material will be economically feasible.

Briefly stated, there is provided a cable comprised of a structural core made of twined wire or other suitable material, including for example natural or man-made non-metallic rope or filament such as cotton, hemp, nylon, etc., advantageously providing desirable flexibility and sufficient tensile strength for the particular application to which the completed cable is directed. The cable further includes an outer layer surrounding the structural core, such outer core being transmissive of, and advantageously transparent to, light. The outer layer is of a material comprised of a suitably resilient thermoplastic, such as for example clear common PVC (polyvinyl chloride) or light transmissive nylon. A coloring agent which does not significantly compromise the transparency of the layer may optionally be added to increase visual vibrancy and aesthetic appeal in lighted situations. A reflective layer is interposed between the structural core and the outer layer, comprised advantageously of a tape having reflective properties, the otherwise delicate nature of such reflective layer being shielded from ambient exposure by the protective clear resilient outer layer.

In accordance with the invention, a method of producing the cable article described herein is disclosed in which a cable extrusion process is employed, and in which a structural core, for example a length of galvanized steel aircraft wire, is drawn through a cross-head, while being wrapped by the reflective tape prior to deposition of the heated and flowable thermoplastic outer layer.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
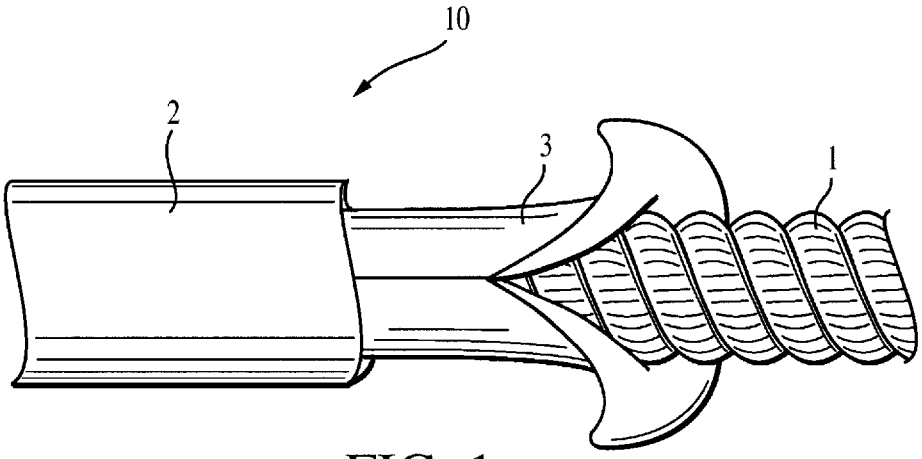
FIG. 1 is a side elevation of a reflectively enhanced coated cable in accordance with an embodiment of the invention.

Referring now to the figures, and in particular FIG. 1, there is depicted, in accordance with an advantageous embodiment of the invention, a coated cable, generally designated 10. Coated cable 10 includes a structural core 1 made of suitable material of longitudinally extended configuration, advantageously providing desirable flexibility and sufficient tensile strength for the particular application to which the completed cable is directed. In the illustrated example, structural core 1 is 7×7 galvanized steel aircraft cable, comprised of seven twisted stranded components, each themselves comprised of seven twisted wires. An outer layer 2 coaxially surrounds structural core 1, and is comprised of an optically transparent material having properties, i.e. flexibility, durability, resiliency, insulative characteristics, etc., suitable for use with the cable application to which coated cable 10 is to be directed. In an embodiment directed to general use, the material comprising outer layer 2 advantageously comprises, for example, a thermoplastic composition which includes common clear PVC (polyvinyl chloride polymer). Optionally, if so desired, a coloring agent, i.e. a pigment which does not significantly reduce the transparent nature of the composition, may be added in a minor amount to the PVC composition to impart a desired color, for added visibility and user appeal under normal lighted conditions or when reflecting light incident thereon.

Means for reflectively enhancing cable 10 are provided, advantageously in the form of a reflective layer 3, which is interposed between structural core 1 and outer layer 2, and comprises, for example, a tape which is wrapped in convenient fashion about structural core 1, advantageously in close contact therewith, to reduce play between layers that might otherwise result on abrasive wear to reflective layer 3. The tape comprising reflective layer is any suitable material possessing sufficient flexibility to permit circumferential wrapping about structural core 1, and being advantageously opaque, while having a high degree of light reflectivity on at least an outer facing surface thereof. Also, as will be described later herein, such material advantageously exhibits non-elastic characteristics such that it not excessively stretched during application about structural core 1. Such material will include, for example, aluminum mylar.

As shown in the depicted example, the tape of reflective layer 3 is wrapped longitudinally about structural core to present a seam running codirectionally with a longitudinal axis of structural core 1, and therefore advantageously has an initial flattened tape width of at least about three (the value of $\pi$) times the diameter of structural core 1 to permit complete radial coverage of structural core 1 when wrapped thereabout, however also advantageously with little or no excess beyond this minimum to prevent excessive overlap. Alternatively, however, other wrapping schemes can be suitably employed, for example, in which the tape is helically wound about structural core 1, or in accordance with any other configuration.

Figure 2:
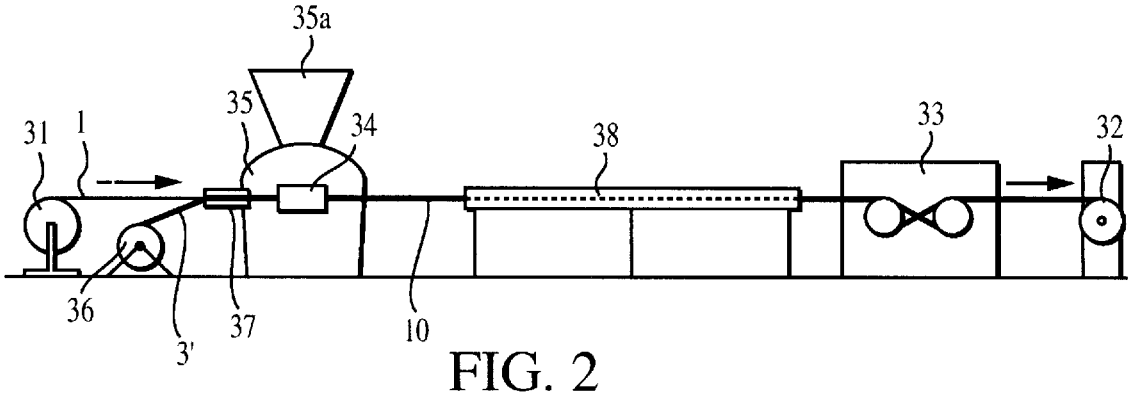
FIG. 2 is a schematic representation of a typical cable extrusion operation for producing the reflectively enhanced coated cable in accordance with embodiment of the invention.
Figure 3:
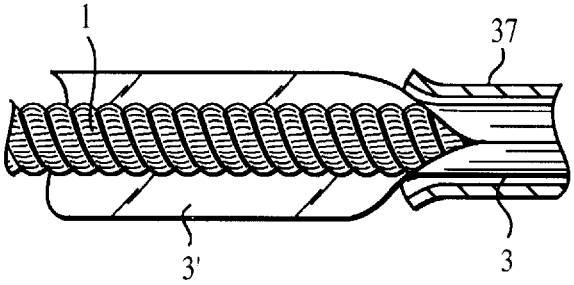
FIG. 3 is detailed plan view showing the tape wrapping mechanism employed in producing a finished coated cable in accordance with an advantageous embodiment of the invention.

In practice, a coated cable in accordance with embodiment of the invention is conveniently produced by modified extrusion practices commonly employed in the production of coated cables. An example of such extrusion process is depicted schematically in FIG. 2, wherein a cable extends between a payoff roll 31 and a take-up roll 32, driven in the direction of the arrows by a motor-driven capstan 33. The production line depicted is directed to extrusion of coated cable 10 of the embodiment described with reference to FIG. 1. As shown, uncoated structural cable core 1 is passed through an extrusion cross-head 34 of conventional construction and configuration, and into which is fed the flowable material comprising outer layer 2 from an extruder 35. Extruder 35 includes a hopper 35*a* in which is received an appropriate thermoplastic or other suitable composition comprising clear outer layer 2, to be melted and transferred under pressure to a port in cross-head 34 for extrusion about cable core 1. Cross-head 34 is of conventional configuration, and includes an internally disposed tip (not shown) configured to center cable core 1 in cross-head 34 and prevent backflow of pressurized thermoplastic within a "gum space" where the pressurized clear material of outer layer 2 is contacted with structural core 1 prior to extrusion through a die (also not shown) at the forward end of cross-head 34. A length of tape 3' which ultimately will comprise reflective layer 3 when interposed between structural core 1 and clear outer layer 2 is provided in wound condition about a tape payoff roller 36 disposed in advance of cross-head 34, such roller 36 being advantageously mounted for damped rotation, i.e. providing a sufficient degree of drag to insure adequate tension in the tape 3' as it is drawn from tape payoff roller 36, and for also preventing overspin should operational advancement of cable 10 be momentarily halted. At the start of operation, an end of the tape 3' of tape payoff roller 36 is fixed to structural core 1 at a point therealong in advance of cross-head 34, advancement of structural core 1 in the direction of the arrows causing continuous payoff of tape from payoff roller 36. A guide tube 37 is positioned between the point of tape attachment to structural core 1 and cross-head 34, through which both tape and structural core 1 pass prior to reaching cross-head 34. As detailed in FIG. 3, flattened tape 3' and structural core 1 enter guide tube 37, and the tape 3' is curled widthwise around structural core 1, the internal dimensions of guide tube 37 permitting clearance-fit passage of the combined diameter presented by both structural core 1 and the tape 3' fed from tape payoff roller 36 which is subsequently curled thereabout. A short distance thereafter, i.e. advantageously less than about one foot, the wrapped tape and structural core 1 enter cross-head 34. The pressure of the incoming melted composition ultimately comprising outer layer 2 forces the tape comprising reflective layer 3 and already wrapped loosely about structural core 1 into close conformance therewith, as the clear flowable material is formed by the extrusion process into clear outer layer 2. Once exiting cross-head 34, the completed coated cable 10 passes through a water trough 38, where it is cooled prior to winding about take-up roll 32.

Dimensions of a completed cable in accordance with various embodiments as contemplated herein are not critical to the invention, and will be determined by the particular application to which the cable is directed.

General considerations, however, will dictate that the outer layer be sufficiently clear notwithstanding thickness to permit reflectivity of incident light upon the reflective layer, and will also have sufficient thickness to adequately shield the reflective layer from environmental degradation, such as caused by abrasion and other deleterious contributory factors. When used as an animal tie-out, for example, a structural core of galvanized steel having a diameter of about ⅛" and an outer layer having a thickness of about 40 mils (0.040") has been found suitable.

Although the above embodiments represent the advantageous modes for carrying out the invention, they are not intended to limit the contemplated scope of the invention. In its broadest sense, the invention provides a coated cable structure which provides enhanced reflectivity of light incident on a surface thereof. Means for reflecting light, disposed on or within the cable structure, are provided in a manner permitting at least partial reflection of light incident on an outer surface of the cable structure. As such this can be provided as indicated above, or alternatively in the form of a reflective outer coating about a base coating surrounding the structural core, or by dispersion of reflective particles, flakes or the like throughout a light transmissive composition for inclusion as part of the resilient layer itself. Furthermore, although the above examples utilize a tape for the reflective means, such layer can alternatively be any other reflective material such as reflective enamel or other material, applied in any suitable manner such as by gluing, coating or painting.

Furthermore, a UV protective agent may be included in the various compositions comprising the corresponding layers of the complete cable coating structure to inhibit light-induced degradation over time.

It is noted that although the cable disclosed herein will find a wide range of application, the invention is deemed particularly advantageous for use as a pet tie-out, wherein by providing enhanced cable visibility, the incidence of a pet owner or child accidentally tripping on the tie-out in low light conditions is reduced. Use of the claimed cable structure is also advantageously applied to construction of barriers and guard rails comprised at least in part of a cable structure to thereby improve highway safety, and as a support cable to tie down or otherwise secure aircraft, in which regard visibility to other aircraft on an airfield is essential for reducing accidents.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A composite cable, comprising:

a structural core;

an outer layer coaxially surrounding said structural core, said outer layer being formed of a thermoplastic composition; and a taped layer comprised of a reflective film material interposed between said structural core and said outer layer, said outer layer being light transmissive, thereby permitting passage of at least a portion of incident light through said outer layer to said taped layer and light reflected back from said taped layer outward of said outer layer to an observer.

2. A composite cable, comprising:

a structural core;

a layer coaxially surrounding said structural core, said layer being formed of an at least partially light transmissive composition; and a reflective layer interposed between said structural core and said layer, said reflective layer being comprised of a material effective for at least partially reflecting light incident thereon whereby said reflective layer imparts reflective enhancement to said composite cable by reflecting at least a portion of light incident upon an outer surface of said composite cable which passes through said layer and impinges said material.

3. The composite cable according to claim 2, wherein said material includes a tape which is at least partially reflective to light on at least a side thereof disposed to face outwardly of said composite cable.

4. The composite cable according to claim 3, wherein said tape includes aluminum mylar.

5. The composite cable according to claim 3, wherein said tape is resistant to stretching.

6. The composite cable according to claim 3, wherein said tape is opaque.

7. The composite cable according to claim 3, wherein said tape is suitably dimensioned such that a width thereof approximates a circumference of said structural core, said tape being circumferentially wrapped about said structural core forming a seam which extends codirectionally with a longitudinal direction of said structural core.

8. The composite cable according to claim 2, wherein said composition includes a thermoplastic.

9. The composite cable according to claim 2, wherein said layer includes a coloring agent.

10. The composite cable according to claim 2, wherein said material comprising said reflective layer includes a reflective enamel coating which at least partially surrounds said structural core.

11. The composite cable according to claim 2, wherein said structural core includes steel aircraft cable.

12. The composite cable according to claim 2, wherein said reflective layer is in direct contact with said structural core.

13. A composite cable, comprising:

a structural core;

a layer coaxially surrounding said structural core, said layer being formed of an at least partially light transmissive thermoplastic composition, said thermoplastic composition including clear polyvinyl chloride; and a material effective for at least partially reflecting light incident thereon, at least a portion of said material being located inward of an outermost surface of said layer, said material imparting reflective enhancement to said composite cable by reflecting at least a portion of light incident upon an outer surface of said composite cable which passes through said layer and impinges said material.

14. The composite cable according to claim 13, wherein said material includes discrete reflective elements which are dispersed in said layer.

15. The composite cable according to claim 14, wherein said discrete reflective elements include at least one selected from the group consisting of particles and flakes.

16. A composite cable, comprising:

a structural core;

a layer coaxially surrounding said structural core, said layer being formed of an at least partially light transmissive composition, said layer including an ultraviolet protective agent; and a material effective for at least partially reflecting light incident thereon, at least a portion of said material being located inward of an outermost surface of said layer, said material imparting reflective enhancement to said composite cable by reflecting at least a portion of light incident upon an outer surface of said composite cable which passes through said layer and impinges said material.

* * * * *